US006547491B1

(12) United States Patent
Haney

(10) Patent No.: US 6,547,491 B1
(45) Date of Patent: Apr. 15, 2003

(54) HYDROSTATIC EQUALIZATION FOR AN OFFSHORE STRUCTURE

(75) Inventor: James Allan Haney, Houston, TX (US)

(73) Assignee: J. Ray McDermott, S.A., Houston, TX (US)

( * ) Notice: Subject to any disclaimer, the term of this patent is extended or adjusted under 35 U.S.C. 154(b) by 0 days.

(21) Appl. No.: 09/528,038

(22) Filed: Mar. 17, 2000

(51) Int. Cl.[7] ..... E02D 23/08
(52) U.S. Cl. ..... 405/195.1; 405/205
(58) Field of Search ..... 405/195.1, 203, 405/205, 209, 218, 219

(56) References Cited

U.S. PATENT DOCUMENTS 3,858,401 A * 1/1975 Watkins ..... 166/350
4,031,581 A * 6/1977 Baugh ..... 405/205
4,241,685 A * 12/1980 Mougin ..... 405/205
4,422,801 A * 12/1983 Hale et al. ..... 166/350
4,521,135 A * 6/1985 Silcox ..... 405/195.1
4,626,136 A * 12/1986 Gunderson ..... 114/265
5,224,962 A * 7/1993 Karal et al. ..... 405/203
5,288,174 A * 2/1994 Kjersem et al. ..... 405/203
5,636,943 A * 6/1997 Haney ..... 405/195.1
5,846,028 A * 12/1998 Thory ..... 405/195.1
6,004,074 A * 12/1999 Shanks, II ..... 405/195.1

* cited by examiner

*Primary Examiner*—Thomas B. Will
*Assistant Examiner*—Alexandra K. Pechhold
(74) *Attorney, Agent, or Firm*—D. Neil LaHaye; Robert C. Baraona; Eric Marich

(57) ABSTRACT

An apparatus and method for pressurizing tubular members of an offshore structure immersed in seawater so that the internal pressure resists the hydrostatic pressure of the seawater. To achieve this internal pressure, compressed air or gas is introduced into the tubular members after the various tubular members are submerged in seawater.

4 Claims, 3 Drawing Sheets

HYDROSTATIC EQUALIZATION FOR AN OFFSHORE STRUCTURE

BACKGROUND OF THE INVENTION

1. Field of the Invention

The invention is generally related to offshore platforms fabricated from tubular members, and more particularly to a method of construction that reduces the impact of seawater pressure on the design of tubular members submerged in seawater.

2. General Background

As is well known to those practiced in the art, the structural members of an offshore platform which are immersed in seawater usually are tubulars and must be designed to resist net external hydrostatic pressure in combination with whatever other loads are imposed on the structural members. The structures normally must be designed to float so that they can be installed using controlled ballasting techniques. Thus, during installation most of the structural members have one atmosphere of pressure on the inside and are exposed to the ambient pressure on the outside. After installation, the structural members are traditionally left void because it would be undesirable and normally not necessary to flood the structural members after the installation. Thus, most of the structural members that are immersed in seawater are exposed to the full ambient hydrostatic pressure during installation and during the life of the structure. For convenience and brevity, the terms "tubular", "tubulars", "tubular members", and "tubular structures" will be used throughout this description to generally refer to the legs and truss members used in offshore structures. It is understood that the present invention is equally applicable to rectangular tubular shaped members or any other member shape such as a jacket launch cradle.

The hydrostatic pressure induces hoop compression in the tubulars. Also, the hydrostatic end forces induce axial compression in the tubulars. The stresses in the structural members caused by the hydrostatic pressure require extra wall thickness and often require that compression reinforcing rings be attached to the structural members at intervals along their lengths. These rings prevent instability and subsequent flattening of the tubular under the action of hydrostatic pressure. The deeper the water and the larger the member diameter, the greater is the expense related to hydrostatics. Ultimately, in deep enough water it becomes impractical to use void members, which means that extra buoyancy must be provided higher up in the structure to float the structure. In short, the design of the structure for hydrostatics becomes increasingly expensive with increasing depth and finally becomes prohibitive.

Another approach to the hydrostatic problem has been considered, but it has been rejected because of concerns over safety. If the members that are most affected by hydrostatics were filled with compressed air in the fabrication yard, then after installation the internal and external pressures acting on the tubulars could be balanced, thereby eliminating the hydrostatic problem. However, to satisfy concerns for safety these tubulars would have to be designed and rated as pressure vessels, which makes the idea too costly to use.

An alternative approach to the hydrostatic problem has been disclosed in U.S. Pat. No. 5,636,943. The proposed method stipulates that during fabrication of the offshore structure, a chemical of the required properties is placed on the inside of the structural members that are to be hydrostatically equalized during installation. The chemical is supplied in each member in the quantity required to generate a volume of gas that will create a pressure on the inside of the member that will be equal to the ambient pressure on the outside of the member when the structure is in its final in-place position. Such a member is said to be hydrostatically equalized. The chemical reaction that generates the gas is initiated by a device that is activated by differential pressure between the inside and outside of the member. In the preferred embodiment, the initiation devices are set at differential pressures that will initiate the gas generation reaction as the structure descends to its in-place position during installation. Thus, the members are not pressurized during fabrication onshore or during installation when the members are above the surface of the ocean, which means that personnel are never exposed to any danger from a pressurized unrated tubular. In fact, the differential set pressures can be chosen so that the tubular members are not exposed to net internal or external pressure that would control the design of the member. Inherent within this procedure is a lack of monitoring and control of the actual pressure generated within the tubular. Additionally, as generally described in the preferred embodiments there is an absence of any procedure to compensate for a lack of internal pressure where defective activation devices or defective chemical gas generating packages may exist.

SUMMARY OF THE INVENTION

The invention addresses the above need. What is provided is an apparatus and method for pressuring tubulars that does not expose personnel to any danger from a pressurized, unrated tubular. During the fabrication of an offshore jacket, compliant tower, or subsea template, tubular members are fabricated using normal practice such that each tubular member will contain an internal pressure of one atmosphere pressure. For selected members that are to be subsequently hydrostatically equalized, hardware means as necessary to permit subsea pressurization and isolation of the tubular internal pressure are installed while the structure remains in an onshore fabrication facility. Once completed, the structure is transported to an installation site, placed in the seawater, and positioned for lowering to a final position. The tubular members that have been selected to be hydrostatically equalized are connected to an umbilical line. Once connected, an isolation valve is opened, allowing compressed gas to be pumped into the tubular member until an internal pressure equal to or greater than the ambient pressure surrounding the brace at it's final location is reached. After the required pressure is achieved, the isolation valve is closed to maintain brace internal pressure until such time as the member reaches its final location and final ambient pressure. The procedure is repeated until all selected tubular members have been hydrostatically equalized. At this point the structure may be safely installed at its final location. Thus, the tubular members are not pressurized during fabrication onshore or when the members are above the surface of the ocean.

BRIEF DESCRIPTION OF THE DRAWINGS

For a further understanding of the nature and objects of the present invention reference should be made to the following description, taken in conjunction with the accompanying drawings in which like parts are given like reference numerals, and wherein.

DETAILED DESCRIPTION OF THE PREFERRED EMBODIMENT

Figure 1:
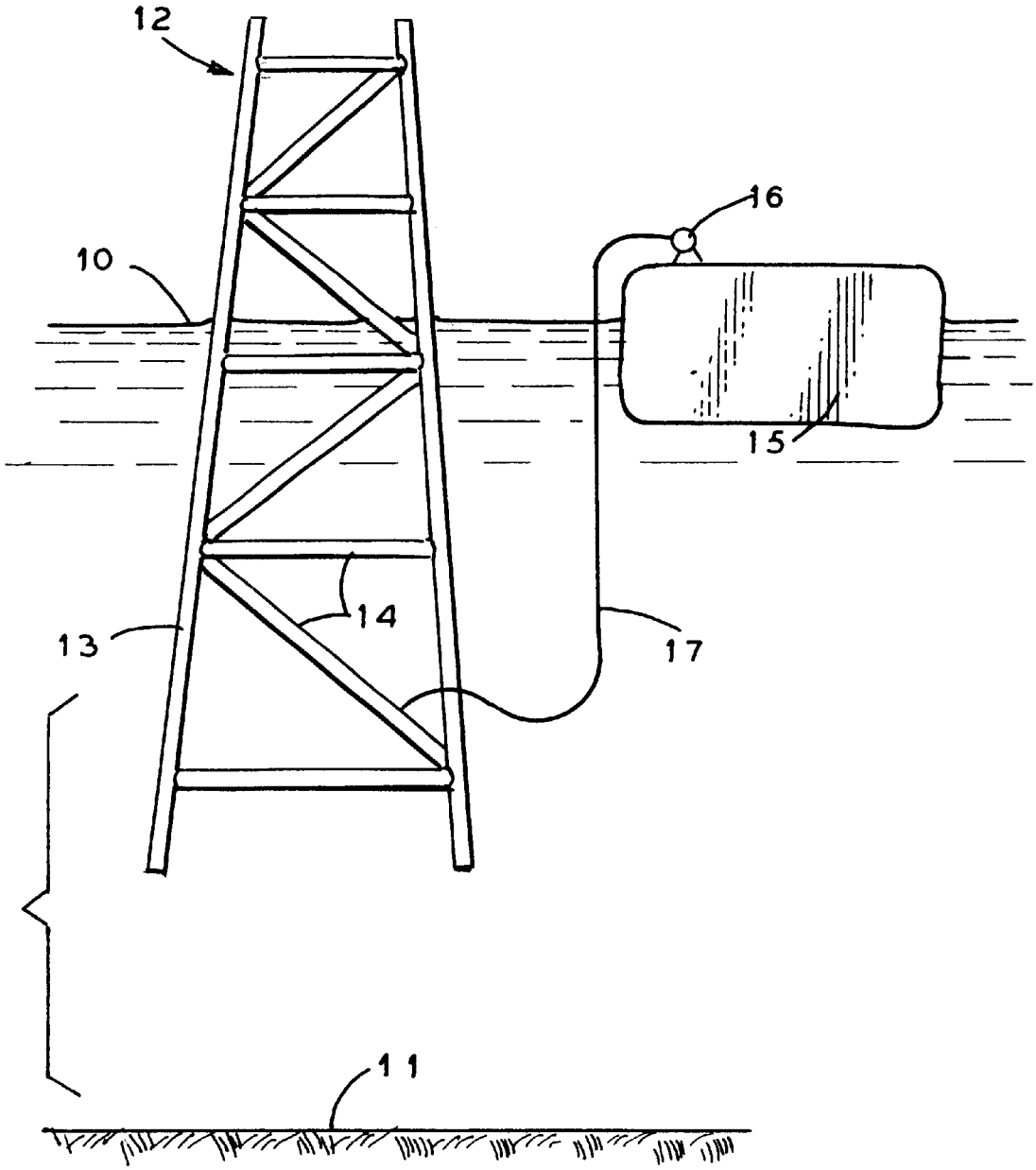
FIG. 1 is a schematic side elevation view of a truss row of a jacket on which the present invention is practiced.

Referring to FIG. 1, tubular legs 13 and tubular truss members 14 comprise an offshore structure generally designated by the numeral 12. Although a jacket is illustrated as offshore structure 12, a compliant tower, subsea template, or other marine structures comprised wholly or partially of tubulars are also intended. As is well known by those practiced in the art, legs 13 and truss members 14 provide buoyancy to the structure 12 and, therefore, are traditionally void, i.e., not flooded and contain air at atmospheric pressure within. In some cases, in order to assist in installation, portions of the legs 13 or truss members 14 must be flooded during installation and subsequently deballasted using procedures which are well known within the industry.

Figure 2:
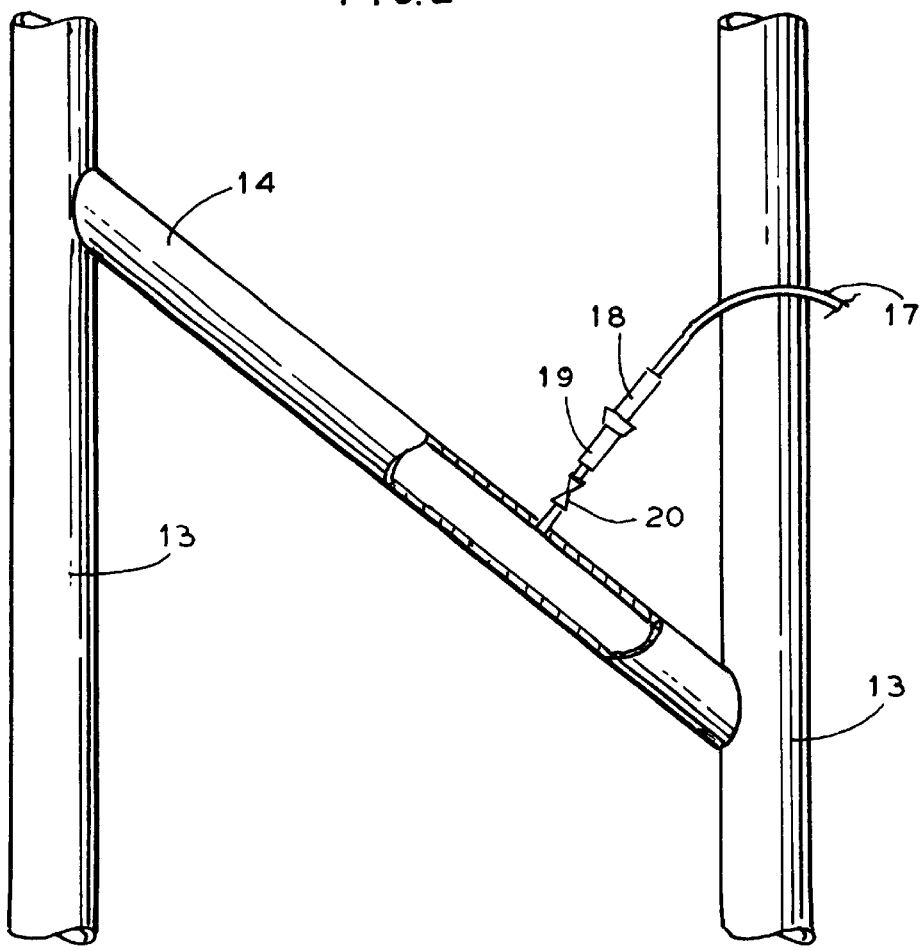
FIG. 2 is a fragmentary view of part of the truss row shown in FIG. 1 embodying the present invention.

The present invention avoids subjecting selected tubulars to significant net external hydrostatic pressure by pressurizing the interior of the tubular during platform installation but prior to lowering the jacket to its final in-place elevation. In the present invention, selected tubular members are outfitted with pressurization fittings or are connected to a pressurization manifold system. One such system is illustrated in FIG. 2. The truss members 14, also referred to as braces, are equipped with an isolation valve 20 and a hot stab receptacle 19.

The procedures for fabrication and installation of an offshore platform according to the invention are as follows. The offshore platform 12 is fabricated with selected truss members 14 being outfitted with pressurization hardware as described above. Using procedures known in the industry, the structure 12 is transported to an installation site, removed from the transportation vessel, and placed in the water. At this point, the structure may be upended in preparation for installation on the sea floor 11.

For safety reasons it is desirable that all the tubular members selected for pressurization be located below the water surface 10. At this point and prior to lowering the structure, various pressurization means may be used to increase the internal pressure of selected truss members 14. One such means is illustrated in FIG. 1. An installation vessel 15 is equipped with an air compressor 16 and a subsea umbilical line 17. Each of the selected truss members 14 is pressurized to a predetermined pressure. Once pressurized, and with the isolation valves 20 closed, the offshore structure 12 may be lowered to the sea floor 11.

During pressurization of the truss member 14, a pressurization umbilical 17 is put in fluid communication with the truss member 14 by insertion of a subsea hot stab 18 into receptacle 19. This may be accomplished by either a diver or an ROV (remotely operated vehicle).

For some applications, and where the circumstances of seawater pressure and tubular member strength permit, it may be more desirable to partially pressurize some of the selected truss members prior to lowering the offshore structure and then complete the pressurization after the structure is lowered to the final position. A truss member of sufficient strength to withstand static seawater pressure but normally requiring either ring stiffeners or internal pressurization to withstand the combination of seawater pressure, imposed topside loadings, and environmental storm loadings is an example of such circumstances. This procedure offers the advantage that lowering of the structure will not be slowed down by pressurization operations. It may also be desirable to pressurize some of the selected truss members after the structure has been lowered to the final position.

The pressurization hardware in FIG. 2, the isolation valve 20, hot stab receptacle 19, and subsea hot stab 18, are intended to serve as an illustrative example only and not to limit the hardware that may be used. For example, a centrally located manifold system offers advantages related to the economy of time and materials. Likewise, means other than the use of an air compressor and umbilical line for delivering pressure to tubular members may be employed.

Figure 3:
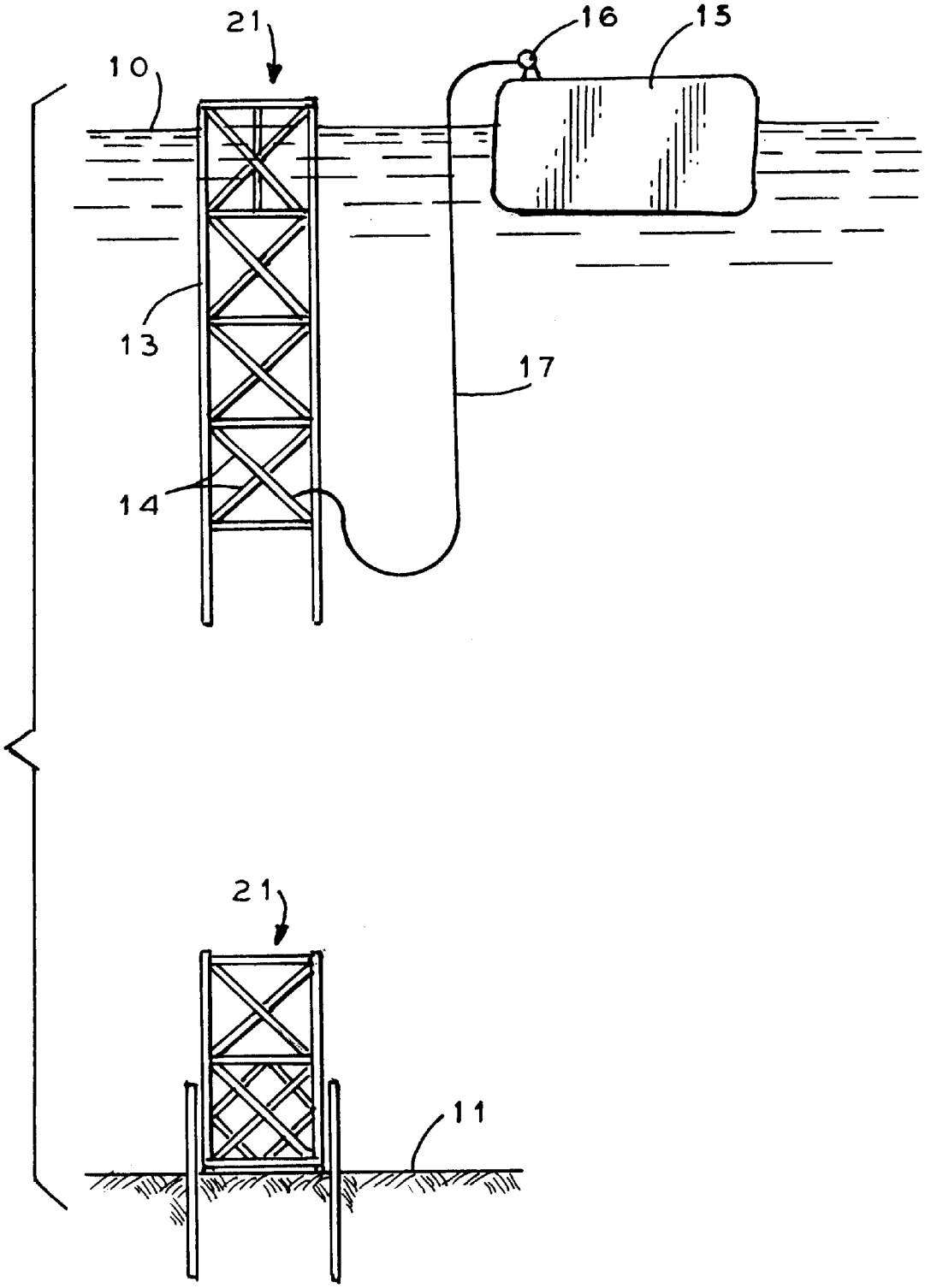
FIG. 3 is a schematic side elevation view of a truss row for two sections of a compliant tower on which the present invention is practiced.

FIG. 3 illustrates the use of the invention where an offshore structure is installed in more than one section. Separate component sections 21 of the structure may be fabricated and then installed as described above. The selected truss members 14 are pressurized as described above.

Advantages of the invention include a reduction of steel weight required for the offshore structure tubular members and the simplification of tubular member fabrication. Weight savings are obtained by the elimination of hydrostatic ring stiffeners and a reduction in tubular member wall thickness. This is a direct result of the elimination of the net pressure acting on the tubular members. Axial compressive loads are reduced by the elimination of the capped end forces normally associated with void tubular members. Likewise, the reduction of compressive loads within members reduces the strength requirements at tubular member joints. All of these advantages are more pronounced with an increase in water depth.

The installation of numerous hydrostatic ring stiffeners along the length of each member during the fabrication process is extremely expensive and disrupts normal fabrication flow. The elimination of these rings greatly simplifies fabrication of the offshore structure.

Strengthening of an existing tubular member according to the present invention provides the advantage of a buoyant member when compared to the procedure of flooding a tubular member to equalize external and internal pressures. Pressurization hardware and deballasting ports as described above are installed in the selected tubular members. Additional internal pressure is introduced into the selected tubular members through the pressurization hardware to a magnitude sufficient to displace internal seawater and to counterbalance ambient hydrostatic pressure, thereby eliminating or reducing tubular member capped end forces.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. A method for the construction and installation of an offshore structure formed from a plurality of tubular members, comprising the steps of:

a. fabricating the offshore structure from tubular members such that air is trapped inside each tubular member at atmospheric pressure;

b. placing the offshore structure into the water;

c. introducing additional internal pressure from a source external to the tubular members and offshore structure into selected tubular members of the offshore structure after submergence in sea water and prior to the tubular members being lowered to a position where the tubular members are subjected to additional external hydrostatic pressure, the additional internal pressure being equal to the additional external hydrostatic pressure.

2. The method of claim 1, wherein the step of introducing additional internal pressure into some of the selected tubular members is accomplished in part prior to lowering the offshore structure to the final position and completed after the offshore structure is lowered to the position where the tubular members are subjected to additional hydrostatic pressure.

3. The method of claim 1, wherein the step of introducing additional internal pressure into selected tubular members is accomplished while the offshore structure is temporarily supported on the sea floor at a shallow water location before the offshore structure is transported to a depth where the tubular members are subjected to additional external hydrostatic pressure.

4. A method for the construction and installation of an offshore structure formed from a plurality of tubular members, comprising the steps of:

a. fabricating the offshore structure from tubular members such that air is trapped inside each tubular member at atmospheric pressure;

b. placing the offshore structure into the water;

c. lowering the offshore structure to a water depth where the tubular members are subjected to additional external hydrostatic pressure; and d. introducing additional internal pressure from a source external to the tubular members and offshore structure into selected tubular members of the offshore structure, the additional internal pressure being equal to the additional external hydrostatic pressure.

* * * * *